US012075925B2

(12) United States Patent
Winger

(10) Patent No.: US 12,075,925 B2
(45) Date of Patent: Sep. 3, 2024

(54) CARRYING DEVICE WITH A WEIGHT DISTRIBUTION SUPPORT

(71) Applicant: HTS HANS TORGERSEN & SØNN AS, Krøderen (NO)

(72) Inventor: Julius Andreas Winger, Oslo (NO)

(73) Assignee: HTS HANS TORGERSEN & SØNN AS, Krøderen (NO)

( * ) Notice: Subject to any disclaimer, the term of this patent is extended or adjusted under 35 U.S.C. 154(b) by 135 days.

(21) Appl. No.: 17/766,895

(22) PCT Filed: Oct. 7, 2019

(86) PCT No.: PCT/EP2019/077089

§ 371 (c)(1),
(2) Date: Apr. 6, 2022

(87) PCT Pub. No.: WO2021/069054

PCT Pub. Date: Apr. 15, 2021

(65) Prior Publication Data

US 2023/0135777 A1 May 4, 2023

(51) Int. Cl.
*A47D 13/02* (2006.01)

(52) U.S. Cl.
CPC ..... *A47D 13/025* (2013.01); *A47D 13/027* (2022.08)

(58) Field of Classification Search
CPC ..... A45F 2004/026; A45F 3/08; A45F 3/12; A45F 4/02; A47D 13/025; A47D 13/027
USPC ..... 224/158–161
See application file for complete search history.

(56) References Cited

U.S. PATENT DOCUMENTS 3,698,608 A * 10/1972 Entwistle ..... A47D 13/025 224/159
3,968,910 A 7/1976 Dye et al.
4,484,700 A * 11/1984 Bush ..... A47D 13/027 224/159
4,746,044 A * 5/1988 Arvizu ..... A47D 11/00 224/155
6,471,105 B1 10/2002 Ammerman et al.
(Continued)

FOREIGN PATENT DOCUMENTS

CA 2 821 329 A1 1/2015
DE 102 28 987 C1 9/2003
(Continued)

OTHER PUBLICATIONS

NL-1009604-C2, Translation, Van Delden A F E, Jan. 11, 2000 (Year: 2000).*
(Continued)

*Primary Examiner* — Nathan J Newhouse
*Assistant Examiner* — Matthew T Theis
(74) *Attorney, Agent, or Firm* — Leydig, Voit & Mayer, Ltd.

(57) ABSTRACT

A carrying device for carrying a child on a shoulder of a person is disclosed. The device comprises a weight distribution support with a first end connected the shoulder strap and a second end connected to the back portion of the carrying device. In use, a force acting on the weight distribution support from below, pushes the shoulder strap and the shoulder support bar in an upward direction such that the first curve is further curved outwards, thus allowing the weight to be evenly distributed over the weight distribution support.

16 Claims, 6 Drawing Sheets

(56) References Cited

U.S. PATENT DOCUMENTS

| | | | | |
|---|---|---|---|---|
| 6,561,394 | B2 * | 5/2003 | Pripps | A47D 13/025 224/159 |
| 9,675,165 | B2 | 6/2017 | Lee et al. | |
| 2004/0262343 | A1 | 12/2004 | Pratt et al. | |
| 2007/0089907 | A1 | 4/2007 | Hartwig et al. | |
| 2014/0231472 | A1 | 8/2014 | Cha | |
| 2015/0313376 | A1 | 11/2015 | Winger | |

FOREIGN PATENT DOCUMENTS

| | | | | | |
|---|---|---|---|---|---|
| GB | 2076636 | A | * | 12/1981 | A47D 13/025 |
| GB | 2378889 | A | * | 2/2003 | A45F 3/10 |
| GB | 2519285 | A | * | 4/2015 | A47D 13/025 |
| KR | 10-1494189 | B1 | | 2/2015 | |
| NL | 1009604 | C2 | * | 1/2000 | A47D 13/025 |
| NO | 336946 | B1 | | 11/2015 | |
| SU | 1680051 | A1 | * | 9/1991 | A47D 13/025 |
| WO | 95/31168 | A1 | | 11/1995 | |
| WO | WO 2014/092580 | A1 | | 6/2014 | |
| WO | 2019/071570 | A1 | | 4/2019 | |

OTHER PUBLICATIONS

SU-1680051-A1 Translation, Teslinov A G, Sep. 30, 1991 (Year: 1991).*

International Searching Authority, International Search Report and Written Opinion in International Application No. PCT/EP2019/077089, mailed Nov. 19, 2019.

Chinese National Intellectual Property Administration, Office Action issued in counterpart Chinese Patent Application No. 201980102784.X, mailed on May 7, 2024.

* cited by examiner

CARRYING DEVICE WITH A WEIGHT DISTRIBUTION SUPPORT

CROSS-REFERENCE TO RELATED APPLICATIONS

This patent application is the U.S. National Stage of International Patent Application No. PCT/EP2019/077089, filed Oct. 7, 2019, which is incorporated by reference.

The invention is directed to a carrying device for carrying a child on a shoulder of a person. More specific, the invention is directed to a shoulder harness system comprising shoulder straps and a weight distribution support allowing the carrying weight to be evenly distributed over the shoulders of the carrier.

BACKGROUND

The carrying of children, especially toddlers, seated astride the adult's shoulders has been a favorite mode of transport for the carried child throughout history.

For the child, it is a chance to see the world from an entirely different perspective than walking, as well as a chance to rest small legs which must work twice as hard to keep up with walking adults.

Conventionally, carrying a child on the shoulders has often required the holding of the child's ankles by the carrier's hands, wherein the child is stabilized and generally prevented from falling backwards. However, a slip of the hands by the adult carrier while the child is leaning backward can have serious results.

For the carrying adult, the weight of the child upon their shoulders, and need to use their hands to control and balance the child, can tend to cause muscle exertion and strain. Additionally, the compressive nature of the weight of the child bearing against the adult's shoulder and neck muscles and bones, and the continual force of the child pulling on their head or neck to maintain themselves upright, can be a source of pain and discomfort significant enough to cause a discontinuance of the ride.

This normally requires a carry device to be constructed such that it allows the weight to be distributed vertically and as close to the weight center of the carrier person as possible. One such device, for example, is shown in publication WO 2014/092580 A1.

The publication discloses a child carrier device for carrying a child on the shoulder of an adult. The device comprises a back support connected to a pair of shoulder harness and wherein the back support and the shoulder harness forming a seating section for a child on the shoulder of the carrying adult. The carrying device comprises shoulder straps attached to rigid support bars. The support bars are rigid and pre-shaped to fit to the shoulder portion of the carrying person and adapted to be carried directly onto the shoulders. The drawback of this system is that the size of the pre-shaping does not fit all users. Furthermore, the weight of the child will lift the free end of the support bar such that the lifting device will revolve backwards, thus moving the weight center backwards.

Norwegian patent NO 336946 B1 discloses a carrying device comprising support bars and shoulder straps arranges below the support bars. The shoulder straps are adjustable at the end connected to the lower part of the frame support by buckles. This solution will also cause the weight distribution to revolve backwards when the shoulder straps are tightened, since the shoulder straps will pull the free end of the support bars upwards and the weight of the child will cause the carrying deice to revolve backwards.

Therefore, there is an object of the present invention to provide a weight distribution support that moves the weight center in a forward direction when a child is sitting in the device.

Another object of the invention is to provide a weight distribution support that automatically adjust to the shoulder size of the carrier and allowing the weight to be evenly distributed over the shoulders of the carrying person.

SUMMARY OF THE INVENTION

The invention is directed to a carrying device for carrying a child on a shoulder of a person.

The term child is referred to a human being between the stages of birth and puberty or between the development period of infancy and puberty. The child may also refer to a minor.

The person carrying the device, may also be referred to as an adult, a person or a carrier. It is obvious that a person carrying the device may be any person capable of carrying a child on the shoulders.

A securing perimeter is referred to an extent of a securing system, i.e. the size of the arch the securing system forms that embraces or encloses the child. The securing perimeter may be adjusted such that it can be sized to fit the child.

The carrying device comprises:

- a back-support frame for supporting the back of the child and extending vertically at a side to a lower end of the of the carrying device,
- a shoulder support bar comprising a free end and with an opposite end connected to the side of the back-support frame such that it forms a first curve which supports the child from below,
- a shoulder harness system comprising a shoulder strap connected to and covering at least a section of the support bar, the shoulder strap further being arranged with a collar extending from the side to an opposite side, and
- a cover attached to an upper section of the back-support frame and connected to the collar such that it provides a seating section for the child behind the collar.

The shoulder harness system further comprises a pack portion attached to a lower section of the back-support frame, and a weight distribution support with a first end connected the shoulder strap and a second end connected to the back portion, such that the weight distribution support forms a second curve located below the first curve, and wherein in use, a force acting on the weight distribution support from below, pushes the shoulder strap and the shoulder support bar in an upward direction such that the first curve are further curved outwards, thus allowing the weight to be evenly distributed over the weight distribution support.

The back portion may be provided with a pocket for holding the lower end of the back-support frame. The back portion may extend upwards along the back-support frame to the connection point of the support bar where the shoulder straps are connected to the back portion. The back portion may be arranged to support the back of the carrier.

The collar may be arranged between the shoulder straps at the top section of the shoulder harness system.

The shoulder support bar may have a varying thickness from the connection point to the back-support frame, and gradually thinner towards the free end. At the connection point, the shoulder support bar may be rigid and wherein the thickness is gradually decreasing towards the free end where the support bare is flexible towards the back portion of the carrying device. The shoulder support bar providing a pre-shaped first curve for fitting to the shoulder of the carrier and proving a support for the legs of the child onto the shoulders of the carrier.

The support bar may me made of any material such as: plastic, polyester, carbon, epoxy, aluminum, etc. or a combination thereof.

Since the support bar may be rigid, the surface of the material may be hard against the shoulder of the carrier, therefore, the shoulder straps may be arranged such that it covers at least a section of the shoulder support bar.

The first end of the weight distribution support may be connected to the shoulder strap at a location in the middle between the ends of the shoulder support bar or closer to the end connected to the support bar.

The second end of the weight distribution support may be connected to the back portion at a location above a mid-section of the back portion.

The second end of the weight distribution support may be located on the carrying device at a vertical location above the first end. Seen from the side, the second end of the weight distribution support may be connected to the upper part of the back portion and arranged in a curve forming a shoulder section and further connected to the shoulder support bar at the first end, which is situated vertically lower than the second end of the weight distribution support.

The specified location of the first and second ends allows a pre-defined bending of the first curve defined by the support bar, when a force is acting on the weight distribution support.

In use, the weight distribution support, automatically bends the first curve into the pre-defined (desired) shape upon loading. This is also advantageous to limit the strain and pressure to the collarbone of the carrier, in that the first curve with the hard and rigid support bar is lifted upwards (away from the collarbone).

The weight distribution support may comprise foam and/or padding for carrying comfort. The weight distribution support may be made of a fabric material such as polyester, cotton, neoprene, pvc, rubber, or a combination thereof.

The carrying device may comprise a counterweight system comprising connection means provided at the free end of the shoulder strap and the support bar. The connection means may comprise a counterweight device arranged to be connected to the connection means so as to provide a counterweight balance to the carrying device.

The counterweight device may be at least any one of a: bag or pouch for holding an item. The device may be arranged with a pocket for holding travelling accessories such as garments, keys, water bottle, food, etc. The counterweight device may be adapted for carrying travelling items for the child and the adults.

The counterweight device may assist to pull the shoulder straps and the support bars in a downward and forward direction, opposite the up and backwards direction of the child, thus creating a counterweight for the carrying device.

The connection means may be a loop provided on the carrying device and hooks provided on the counterweight device for interaction.

The connection means may comprise at least any one of a: buckle, strap, Velcro, push button, hook, magnets, etc.

The carrying device comprises may comprise a back-support device with a top and sides for supporting the back of the child, and a shoulder harness system comprising shoulder straps connected to the back-support device providing a seating section above and behind the shoulder straps.

The carrying device may further comprise a safety device for retaining the child in a seated position. The safety device comprises an outer securing system extending between the sides of the back-support device providing an outer securing perimeter for the child, and an inner securing system arranged within the outer securing system and providing an inner securing perimeter which is smaller than the outer securing perimeter, wherein the inner securing system is adapted to be adjusted independent of the outer securing system.

The safety device may be used in different arrangement of a child carrying device.

The back-support device may comprise a frame or a plate for supporting the back of the child. The frame of the plate may be made of any material such as: polymer, plastics, aluminum, wood, fabric, etc. or a combination thereof.

The back-support device may comprise a back-support frame of tubes with a U-shape and extending vertically at the sides to a lower end of the of the carrying device. The back-support frame may also have different shapes such as pyramidical, square, oval, etc.

The carrying device may comprise a support bar comprising a free end and with an opposite end connected to the back-support frame such that it forms a first curve which supports the child from below.

The shoulder harness system may comprise the shoulder strap connected to and covering at least a section of the support bar, the shoulder straps may further be arranged with a collar extending between each other.

A cover attached to an upper section of the back-support frame and connected to the collar such that it provides the seating section for the child behind the collar.

The child carrying device may comprise a safety device for retaining the child in a seated position. The safety device comprises:

- an outer securing system providing an outer securing perimeter for the child, and
- an inner securing system arranged within the outer securing system and providing an inner securing perimeter which is smaller than the outer securing perimeter, wherein the inner securing system is adapted to be adjusted independent of the outer securing system.

The inner securing system may be attached to the cover and connected to the outer securing system.

The inner securing system may comprise inner connection means for connecting and adjusting the inner securing system and the outer securing system may comprise outer connection means for connecting and adjusting the outer securing system.

The inner and outer connection means may comprise at least any one of a: buckle, strap, Velcro, push button, hook, magnets, etc.

The outer securing system may comprise a first flap connected to one side of the child carrying device and a second flap connected to opposite side, wherein the first and second flaps are provided with adjustment strap and/or buckle for paring and adjustment.

The outer securing perimeter are defined by the length between the first and second flap (hence, the distance between the sides of the carrying device) and the length of the straps together with the adjustment strap. When tightened the most, the outer securing perimeter provides a minimum securing perimeter of the outer securing system which are defined by the distance between the sides of the carrying device.

Thus, for a big child this minimum perimeter may be enough for securing the child for retaining it in the seated position in the carrying device. For a smaller child, the minimum securing perimeter of the outer securing perimeter may still be too big, especially in the sideways direction of the child, such that the smaller child may risk falling out of the carrying device.

This invention solves this problem by proving an inner securing system which is arranged within (or at the inside) of the outer securing system. The inner system is adapted to be adjustable independent of the outer securing system.

Furthermore, the inner securing system is connected to the outer securing system, thus allowing the inner securing system to be adjusted to the size of the child prior to attaching and adjusting the outer securing system.

For a person using the carrying device the inner securing system may first be adjusted to the size of the child, and wherein the carrying device may be fitted on the shoulders of the person prior to lifting the child into the carrying device. When attaching the flaps of the outer securing system and adjusting it accordingly, the inner securing system is automatically connected and adjusted.

A buckle may be a flat, typically rectangular frame with a hinged pin, used for joining the ends of a belt or strap. Different types of buckles for joining parts and which also provides adjusting opportunities are well known in the art and are therefore not described further in this application.

The flaps may be connected to the side of the cover or they may be connected to the back-support frame. The location may be around the lower chest or in the stomach region of the child when it is seated in the carrier device.

At the back region of the cover, i.e. the cover side opposite the side facing the child, may be provided with back-cover strap adapted for adjusting the depth of the sitting section and back of the child. The cover may be pre-shaped to form a space to fit the seat and back of the child. According to the size of the child the space may be adjusted by the back-cover strap. The back-cover strap may be connected to the back-support frame at the same height as the first and second flaps. The adjustment mechanism may be a buckle or a loop.

The inner securing system may comprise an inner strap with a first end and a second end, wherein the first end is connected to the first flap and the second end is connected to the second flap, via the cover. The cover may be provided with a loop or opening, where the inner strap is threaded through.

The inner strap may be attached to the cover at a vertical front centerline of the carrying device.

The inner securing system may comprise a loop device connected to respective first and second flap for securing each end of the inner straps. The first and second ends are threaded through the loop device and fastened by Velcro to the inner strap. Hence, the inner strap may be adjusted independent of the outer securing system by moving the Velco attachment.

A method of securing a child to a carrying device may comprises the steps of:

adjusting the inner securing system according to the size of the child, opening the outer securing system by loosening an adjustment strap and buckle, fitting the carrying device on the shoulders, lifting the child up and into the carrying device, making sure that the child if lifted into the outer securing perimeter of the outer securing system, tightening the outer and inner securing device by fastening the buckle and pulling the adjustment strap.

The above-mentioned method may be performed by the person carrying the child, since the buckle and the adjustment strap is located above the head of the carrying person. By fastening and adjusting the outer securing system, the inner securing system is being attached simultaneously.

FIGURES

The description above, as well as further objects, features and advantages of the present invention will be more fully appreciated by reference to the following detailed description of the preferred embodiment which should be read in conjunction with the accompanying drawings in which.

DETAILED DESCRIPTION OF THE FIGURES

Figure 1:
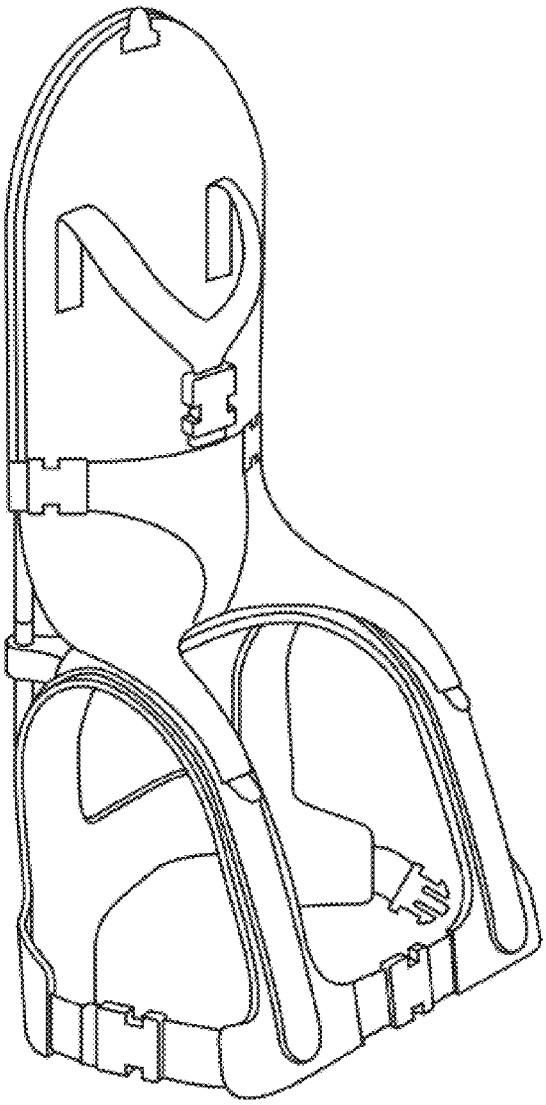
Fig. 1 (prior art)
FIG. 1 shows a prior art carrying device comprising a safety device.

FIG. 1 shows a prior art carrying device for carrying a child on the shoulder of an adult. The device comprises a back support connected to a pair of shoulder harness and wherein the back support and the shoulder harness forming a seating section for a child on the shoulder of the carrying adult. The carrier further comprises a safety securing system for retaining the child in the seated position. The securing system comprising a T-shaped waistband extending from one side of the back support to the opposite side. The waistband is connected to a Y-shaped support strap and extends to the back and attached to the back support. The head of the child needs to be threaded into the Y-shaped support strap and afterward the support strap is secured to the waistband. The T-shaped waistband is adapted for side adjustment, while the Y shaped support strap is adapted for height adjustment.

The prior art carrying device further comprises a support bar connected to a lumar support forming a pre-shaped arch fitting to a shoulder of a carrying person. The shoulder straps are covering the support bars for support between the shoulder and the support bar.

Figure 2:
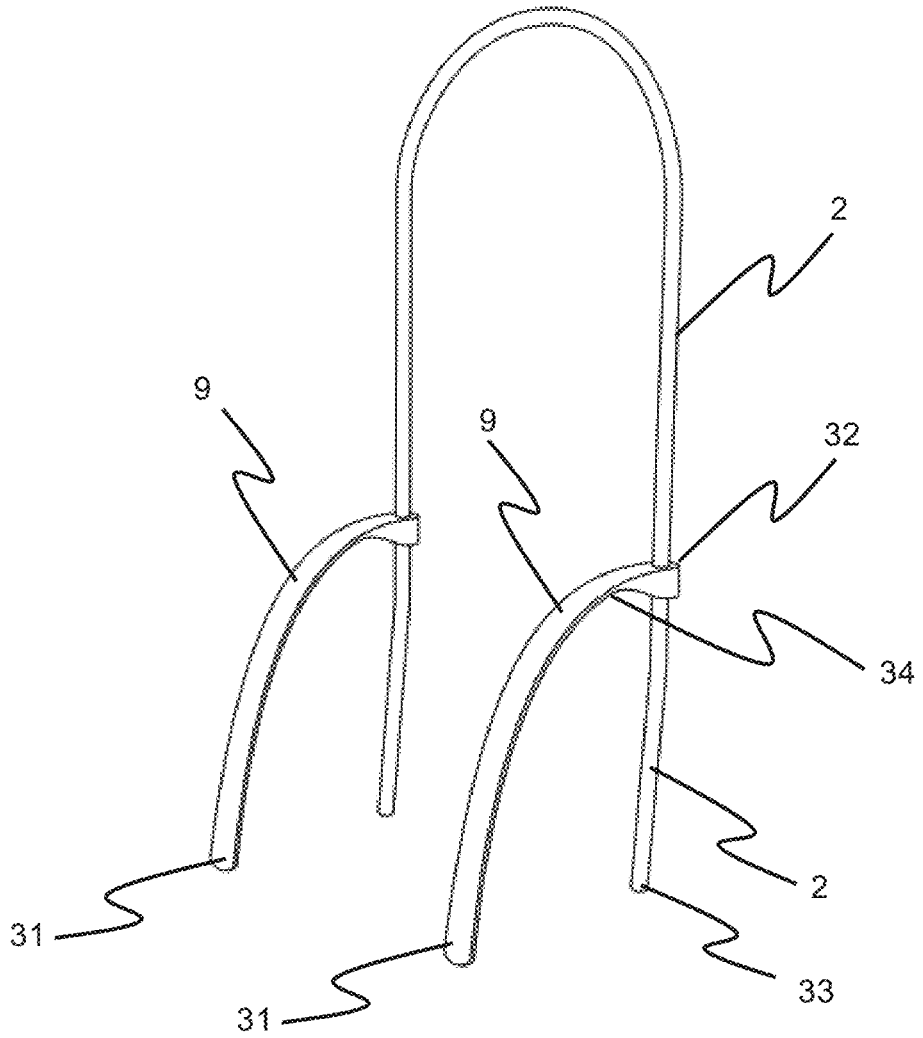
FIG. 2 shows a back-support frame and a pair of support bars connected to the back-support frame.

FIG. 2 shows the back-support frame 2 of an embodiment of the present invention, for supporting the back of the child while seated in in the carrying device 1. Said frame 2 may constitute a bar arranged in an up down U shape (with U shape on top) and extending vertically at both side to a lower end of the of the carrying device 1. Other shapes of the top part may also be possible, such as pyramidical or with edges (part of a square). At the lower end, the back-support frame 2 may be connected to the back portion of the shoulder harness system 3.

The bar of the back-support frame 2 may be arranged such that it is foldable (not shown). It may be foldable to either side of the carrying device. For easy packing, it may be preferable that the top part (the U-shape) of the back-support frame is foldable towards the front of the carrying device, thus enclosing the front part together with the shoulder harness system 3.

As shown in FIG. 2, two support bars 9 each comprising a free end 31 and an opposite end 32 connected to respective side of the back-support frame 2, are arranged for supporting the child from below. While in the seated position the thighs and legs of the child is resting on the two support pars 9. It may be preferable that the support bars 9 are made of rigid material that are most rigid at the connection point of the support bar 9 to the back-support frame 2, and gradually being less rigid towards the free end 31. The support bars 9, each forming a first curve 34 for fitting to a shoulder of the person carrying the device 1.

The carrying device further comprises a shoulder harness system 3 comprising a shoulder strap 17 connected to and covering at least a section of the support bar 9. The shoulder strap may be provided with a pocket for holding and covering the support bar 9.

The shoulder harness system 3 may comprise a back portion 18 attached to the shoulder traps 17 for supporting the back of the carrier 1. The back portion 18 may comprise pockets for holding the lower ends 33 of the back-support frame 2.

The shoulder straps 17 further being arranged with a collar 4 between each other. The collar 4 may be padded for comfort and fit to the neck of the carrier 1.

A cover 5 may be attached to an upper section (up down U-shape) of the back-support frame 2 and connected to the collar 4 such that it provides a seating section 16 for the child behind the collar 4. The cover 5 may be made of a fabric material such as polyester, cotton, neoprene, pvc, rubber, or a combination thereof.

Figure 3:
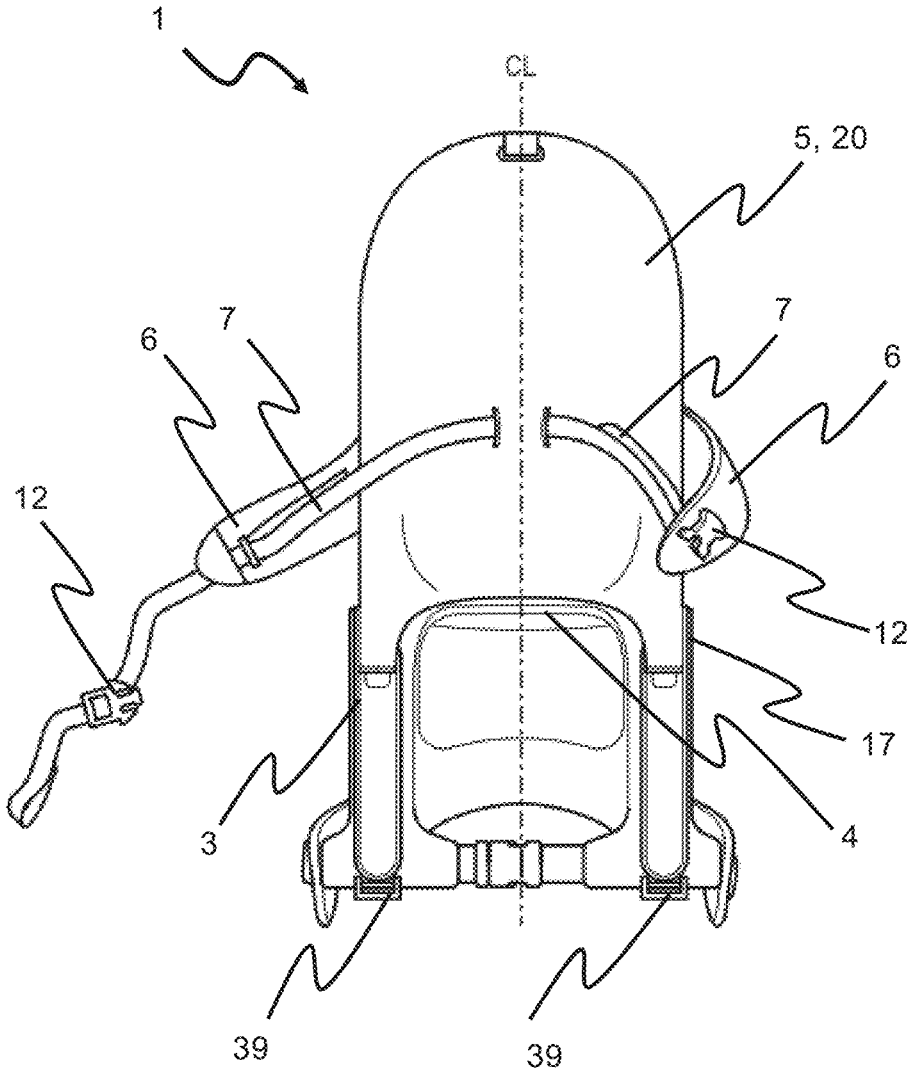
FIG. 3 shows a front side of the carrying device comprising an outer- and inner securing system according to the invention.

As shown in FIG. 3, the child carrying device 1 further comprises a safety device for retaining the child in a seated position, the safety device comprises: an outer securing system 6 providing an outer securing perimeter for the child, and an inner securing system 7 arranged within the outer securing system 6 and providing an inner securing perimeter which is smaller than the outer securing perimeter.

The inner securing system 7 is adapted to be adjusted independent of the outer securing system 6.

The inner securing system 7 comprises an inner strap 7 with ends connected to loops provided at respective flaps of the outer securing system 6. The ends of the inner strap may comprise Velcro for adjusting the length of the inner strap. The inner strap is further connected to the cover 5 through an opening provided in the cover. The inner strap may be attached to the cover 5 at a vertical front centerline (cl) of the carrying device 1. The inner securing system 7 proving an inner securing perimeter defined by the inner strap.

The outer securing system 6 may comprise two flaps arranged on respective sides of the carrying device 1. The two flaps may be arranged with outer strap and buckles for connecting and adjusting the flaps. The outer securing system 6 providing an outer securing perimeter defined by the flaps, the outer strap and the buckles.

The outer securing system 6 is arranged such that it closes both the outer and inner securing system 6,7 when it is closed by the buckles and adjusted by the outer straps.

In use, the inner securing system 6 may be first adjusted according to the size of the child, wherein the carrying device is fitted on the shoulders of the carrier. The child is then lifted into the seating section of the device 1. A carrying person may reach the outer securing system 6 (flaps provided at each side) and fasten the buckles of the outer securing system 6. The outer securing strap is reachable above the shoulder of the carrier such that the inner and outer securing system 6,7 may be tightened by pulling the strap end of the outer securing system 6. Thus, providing a flexible and double securing system for retaining the child in the seated position on the shoulders of the carrier.

Figure 4:
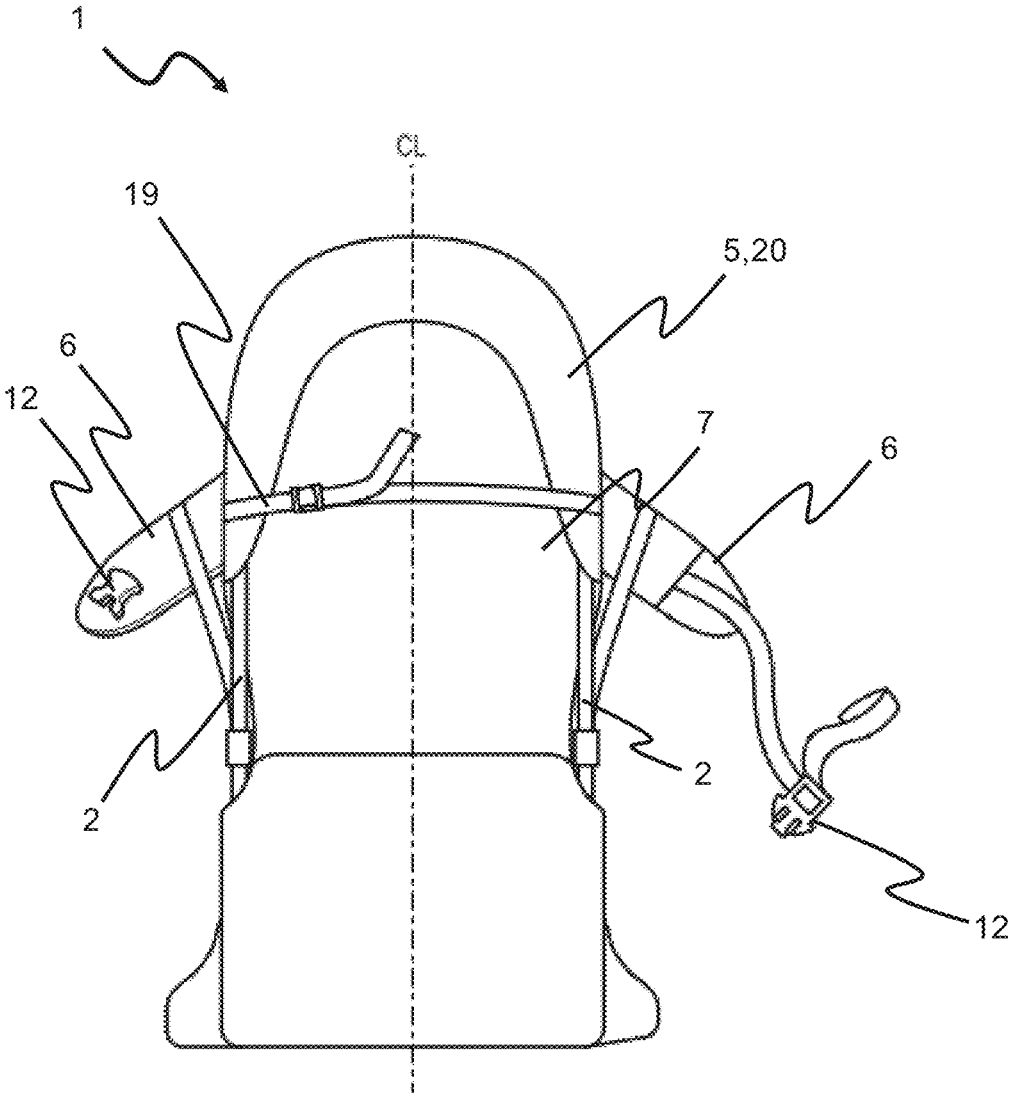
FIG. 4 shows the back side of the carrying device comprising a seat adjusting device.

FIG. 4 shows the back side of the carrying device 1. The back-support frame 2 constitutes a bar with an up down U-shape top portion. A cover 5 provided with a pocket for holding the upper section (up down U-shape) of the back-support frame 2. A seat adjustable strap 19, adjustable through a buckle, is provided from one side of the carrying device to the opposite. The seat adjustable strap 19 may be located at the back of the flaps of the outer securing system 6.

Also shown in FIG. 4, the ends of the back-support frame 2 extends on either side to the lower end of the carrying device 1. At the lower portion of the back-support frame, said frame 2 is connected to a back portion 18 of the shoulder harness system 3.

Figure 5:
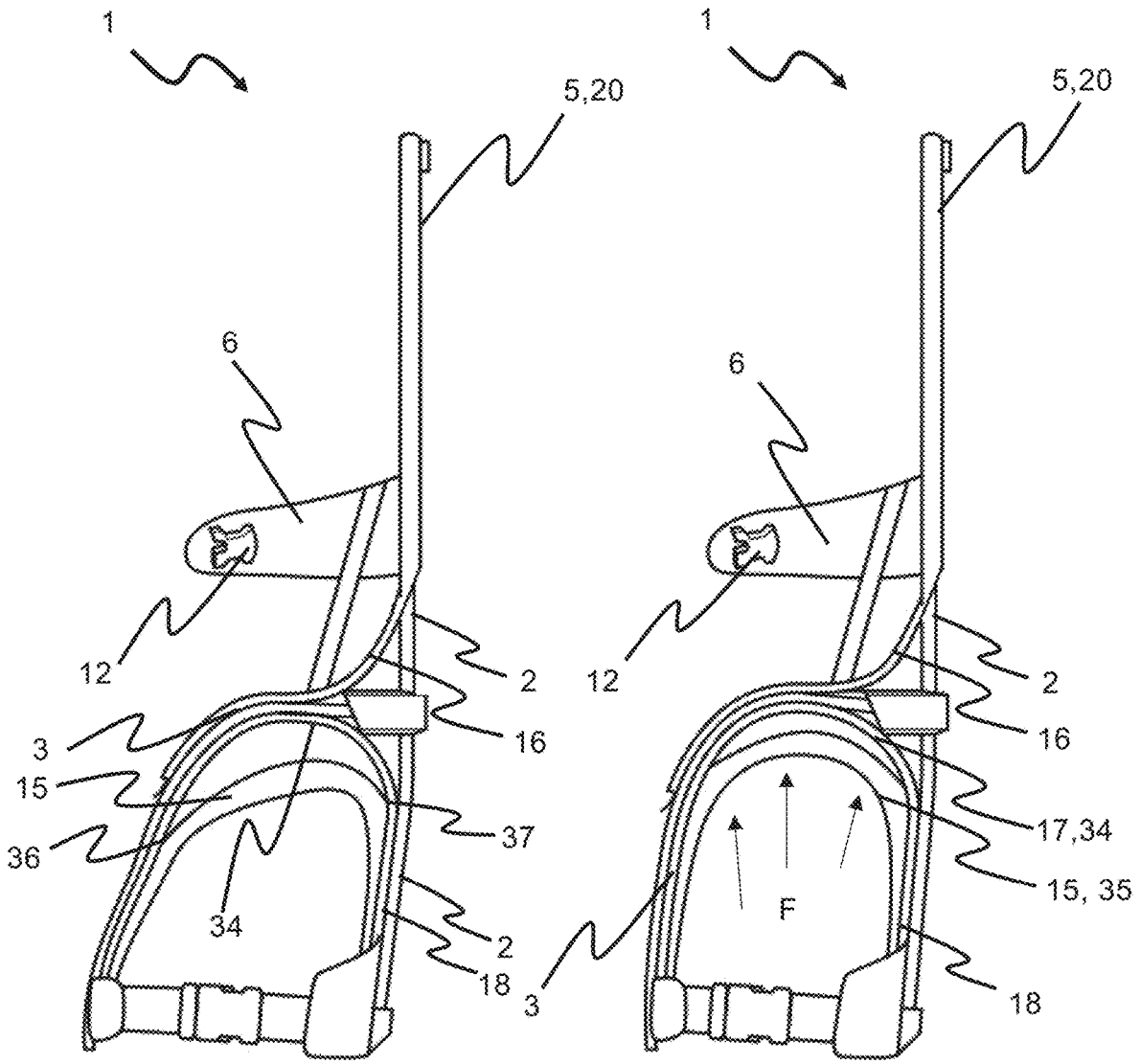
FIG. 5 shows a side view of the carrying device.

FIG. 5 shows a side view of the carrying device 1. The device may comprise a back-support frame 2 for supporting the back of the child and extending vertically at a side to a lower end 33 of the of the carrying device. A shoulder support bar 9 comprising a free end 31 and with an opposite end 32 connected to the side of the back-support frame 2 such that it forms a first curve 34 which supports the child from below. A shoulder harness system 3 comprising a shoulder strap 17 is connected to and covering at least a section of the support bar 2. The two shoulder straps 17 are further being arranged with a collar 4 extending between each other.

A cover 5 is attached to an upper section of the back-support frame 2 and connected to the collar 4 such that it provides a seating section 16 for the child behind the collar 4.

The shoulder harness system 3 may further comprise a pack portion 18 attached to a lower section of the back-support frame 2, and a weight distribution support 15 with a first end connected the shoulder strap 17 and a second end connected to the back portion 18, such that the weight distribution support 15 forms a second curve 35 located below the first curve 34, and wherein in use, a force (F) acting on the weight distribution support 15 from below, pushes the shoulder strap 17 and the shoulder support bar 9 in an upward direction such that the first curve 34 are further curved outwards, thus allowing the weight to be evenly distributed over the weight distribution support 15. This is illustrated in FIG. 5 where the arrows illustrate the force (F) acting on the second curve 35 such that it pulls the front part of the shoulder strap 17 and the support bar 9 upwards and the free end 31 of the support bar 9 inwards towards the upper stomach region of the carrier.

The first end 36 of the weight distribution support may be connected to the shoulder strap 17 at a location in the middle between the ends of the shoulder support bar 9 or closer to the end connected to the back-support frame 2.

The second end 37 of the weight distribution support 15 may be connected to the back portion 18 at a location above a mid-section of the back portion 18.

The second end 37 of the weight distribution support 15 may be located on the carrying device 1 at a vertical location above the first end 36. Seen from the side, the second end 37 of the weight distribution support 15 may be connected to the upper part of the back portion 18 and arranged in a second curve 35 forming a shoulder section and further connected to the shoulder support bar 2 at the first end 36, which is situated vertically lower than the second end 37 of the weight distribution support 15.

The weight distribution support 15 may comprise foam and/or padding for carrying comfort.

Figure 6:
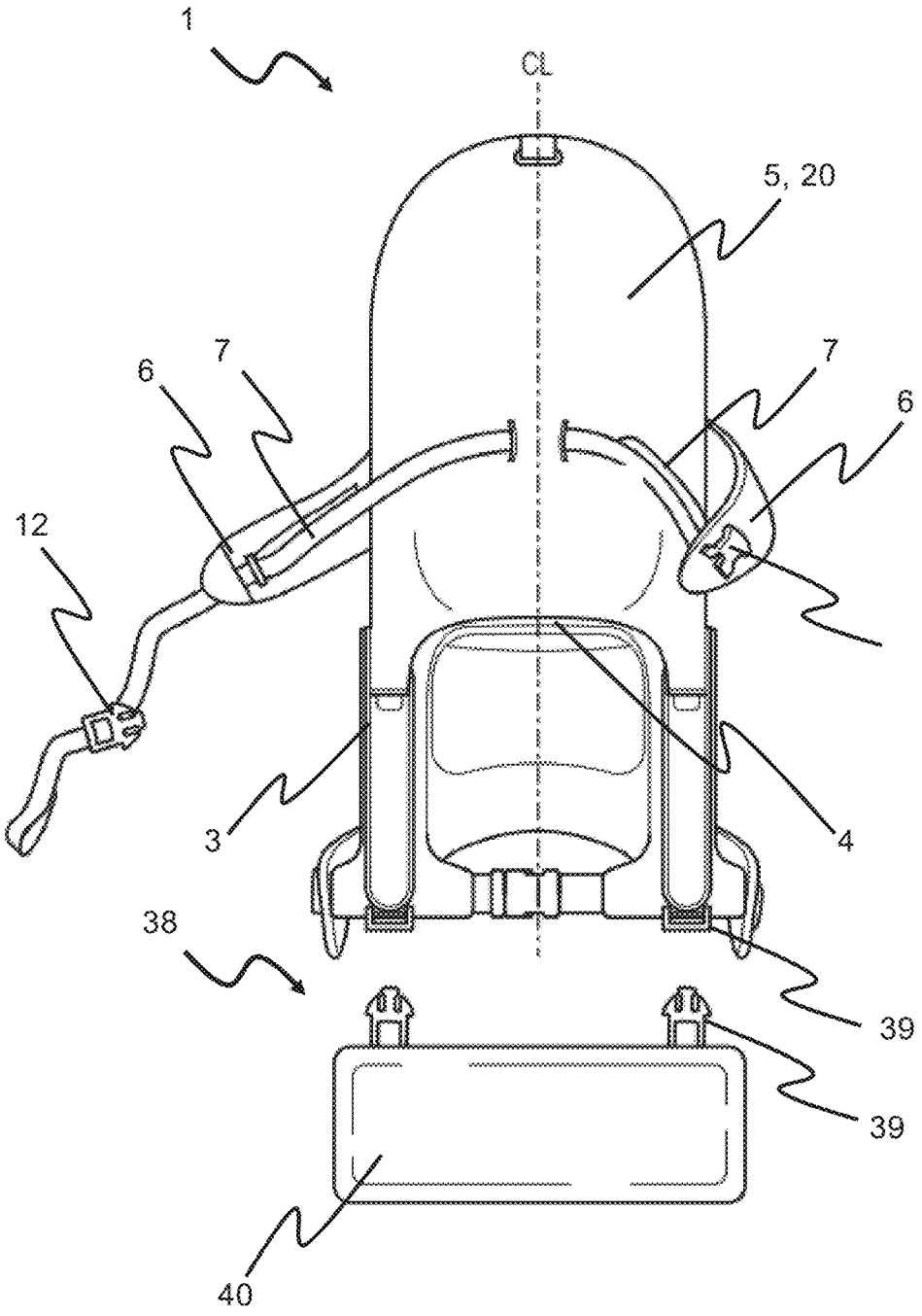
FIG. 6 shows the carrying device and the weight distribution system.

The carrying device 1 may comprise a counterweight system 38 comprising connection means 39 provided at the free end 31 of the shoulder strap 17 and the support bar 2. The connection means 39 may comprise a counterweight device 40 arranged to be connected to the connection means 39 so as to provide a counterweight balance to the carrying device 1. Such a counterweight system 38 is shown in FIG. 6.

The counterweight device 40 may be at least any one of a: bag or pouch for holding an item. The device 40 may be arranged for holding travelling accessories such as garments, keys, water bottle, food, etc. Thus, the counterweight device 40 may be adapted for carrying travelling items for the child and the adults.

The counterweight device 40 may assist to pull the shoulder straps 17 and the support bars 9 in a downward forward direction, opposite the up and backwards direction of the child, thus creating a counterweight for the carrying device 1.

The connection means 39 may be a loop provided on the carrying device 1 and hooks provided on the counterweight device 40 for interaction.

The invention claimed is:

1. A carrying device for carrying a child on a shoulder of a person, the carrying device comprising a back-support frame for supporting the back of the child and extending vertically at a side to a lower end of the carrying device, a shoulder support bar comprising a free end and with an opposite end connected to the side of the back-support frame such that it forms a first curve which supports the child from below, a shoulder harness system comprising shoulder straps connected to and covering at least a section of the shoulder support bar, the shoulder straps further being arranged with a collar extending between each of the shoulder straps, a cover attached to an upper section of the back-support frame and connected to the collar such that it provides a seating section for the child behind the collar, wherein the shoulder harness system further comprises a back portion attached to a lower section of the back-support frame, and a weight distribution support with a first end connected the shoulder strap and a second end connected to the back portion, such that the weight distribution support forms a second curve located below the first curve, and wherein in use, a force acting on the weight distribution support from below, pushes the shoulder straps and the shoulder support bar in an upward direction such that the first curve is further curved outwards, thus allowing weight to be evenly distributed over the weight distribution support.

2. The carrying device) according to claim 1, wherein the first end of the weight distribution support is connected to the shoulder strap at a location in the middle between the free and opposite ends of the shoulder support bar or closer to the opposite end connected to the back-support frame.

3. The carrying device according to claim 2, wherein the second end of the weight distribution support is connected to the back portion at a location above a mid-section of the back portion.

4. The carrying device according to claim 2, wherein the second end of the weight distribution support is located on the carrying device at a vertical location above the first end.

5. The carrying device according to claim 2, wherein the weight distribution support comprises foam and padding for carrying comfort.

6. The carrying device according to claim 2, wherein the carrying device comprises a weight distribution system comprising connection means provided at the free end of the shoulder support bar, wherein the connection means comprises a counterweight device arranged to be connected to the connection means so as to provide a counterweight balance to the carrying device.

7. The carrying device according to claim 1, wherein the second end of the weight distribution support is connected to the back portion at a location above a mid-section of the back portion.

8. The carrying device according to claim 7, wherein the second end of the weight distribution support is located on the carrying device at a vertical location above the first end.

9. The carrying device according to claim 7, wherein the weight distribution support comprises foam and padding for carrying comfort.

10. The carrying device according to claim 7, wherein the carrying device comprises a weight distribution system comprising connection means provided at the free end of the shoulder support bar, wherein the connection means comprises a counterweight device arranged to be connected to the connection means so as to provide a counterweight balance to the carrying device.

11. The carrying device according to claim 1, wherein the second end of the weight distribution support is located on the carrying device at a vertical location above the first end.

12. The carrying device according to claim 1, wherein the weight distribution support comprises foam and padding for carrying comfort.

13. The carrying device according to claim 1, wherein the carrying device comprises a weight distribution system comprising connection means provided at the free end of the shoulder support bar, wherein the connection means comprises a counterweight device arranged to be connected to the connection means so as to provide a counterweight balance to the carrying device.

14. The carrying device according to claim 13, wherein the counterweight device is at least any one of a: bag or pouch for holding an item.

15. The carrying device according to claim 14, wherein the connection means comprises at least any one of a: buckle, loop, straps, a hook and loop fastener, and a press button for securing the counterweight device to the shoulder straps.

16. The carrying device according to claim 13, wherein the connection means comprises at least any one of a: buckle, loop, straps, a hook and loop fastener, and a press button for securing the counterweight device to the shoulder straps.

* * * * *